US008834191B2

(12) United States Patent
Yeh et al.

(10) Patent No.: US 8,834,191 B2
(45) Date of Patent: Sep. 16, 2014

(54) ELECTRICAL CONNECTOR HAVING HOLDER FOR CARRYING AN IC PACKAGE

(71) Applicant: Hon Hai Precision Industry Co., Ltd., New Taipei (TW)

(72) Inventors: Cheng-Chi Yeh, New Taipei (TW); Fang-Jwu Liao, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 43 days.

(21) Appl. No.: 13/626,885

(22) Filed: Sep. 26, 2012

(65) Prior Publication Data

US 2013/0078827 A1 Mar. 28, 2013

(30) Foreign Application Priority Data

Sep. 26, 2011 (TW) ..... 100217981 U
Mar. 30, 2012 (TW) ..... 101205819 U

(51) Int. Cl.
*H01R 13/62* (2006.01)

(52) U.S. Cl.
USPC ..... 439/331; 439/73; 439/326

(58) Field of Classification Search
USPC ..... 439/331, 73, 326
See application file for complete search history.

(56) References Cited

U.S. PATENT DOCUMENTS

| | | | | |
|---|---|---|---|---|
| 4,843,223 | A * | 6/1989 | Shino | 235/487 |
| 6,971,902 | B2 | 12/2005 | Taylor et al. | |
| 7,059,885 | B2 | 6/2006 | Szu et al. | |
| 7,083,456 | B2 | 8/2006 | Trout et al. | |
| 7,384,294 | B2 * | 6/2008 | Washino et al. | 439/326 |
| 8,506,316 | B2 * | 8/2013 | Tsai et al. | 439/331 |
| 2006/0148298 | A1 * | 7/2006 | Nakao et al. | 439/331 |
| 2008/0045048 | A1 * | 2/2008 | Ma | 439/73 |
| 2008/0153323 | A1 * | 6/2008 | Ju et al. | 439/73 |
| 2009/0176397 | A1 * | 7/2009 | Yeh et al. | 439/331 |

* cited by examiner

*Primary Examiner* — Gary Paumen
(74) *Attorney, Agent, or Firm* — Wei Te Chung; Ming Chieh Chang

(57) ABSTRACT

An electrical connector for electrically connecting an IC package to a circuit board includes an insulating housing having a number of contacts received therein, a load plate covering the insulating housing and rotating between an open position and a closed position and a holder assembled on the load plate for retaining the IC package. The holder is sandwiched between the insulating housing and the load plate and capable of loading the IC package to the insulating housing when the load plate is rotated to a close position.

20 Claims, 13 Drawing Sheets

ELECTRICAL CONNECTOR HAVING HOLDER FOR CARRYING AN IC PACKAGE

BACKGROUND OF THE DISCLOSURE

1. Field of the Disclosure

The present disclosure relates to an electrical connector for connecting an IC package with a circuit board, and particularly to an electrical connector including a holder for carrying the IC package.

2. Description of Related Art

Electrical connectors for mounting an IC package to a circuit board are widely used in electrical equipments. The related conventional electrical connector such as disclosed in U.S. Pat. No. 7,059,885, issued to Szu, et al. comprises an insulating housing with a plurality of contacts received therein for electrically contacting the IC package, a stiffener surrounding the insulating housing, a load plate pivotally engaged to one end of the stiffener, and a lever engaged to the other end of the stiffener for fastening the load plate onto the insulating housing. When used, firstly the IC package is put into the insulating housing in a predetermined position by a user; secondly the load plate is driven to cover the IC package; and then the lever is driven to fasten the load plate onto the insulating housing. Thus, the IC package is sandwiched between the insulating housing and the load plate and electrically connecting with the contacts received in the insulating housing.

However, in the above mentioned electrical connector, the IC package should be put into the insulating housing by a user manually. Thus the risk of damaging the contacts is higher, and the IC package is always away from its predetermined position. Therefore, the reliability of the mechanical and electrical performance is decreased.

In view of the above, an improved electrical connector is desired to overcome the problems mentioned above.

SUMMARY OF THE DISCLOSURE

Accordingly, an object of the present disclosure is to provide an electrical connector with holder for carrying an IC package and loading the IC package into an insulating housing, therefore ensuring reliability connecting performance of the electrical connector.

According to one aspect of the present disclosure, an electrical connector is provided for electrically connecting an IC package to a circuit board. The electrical connector comprises an insulating housing having a plurality of contacts received therein, a load plate covering the insulating housing, and a holder assembled on the load plate for carrying the IC package and loading the IC package into the insulating housing.

Other objects, advantages and novel features of the disclosure will become more apparent from the following detailed description when taken in conjunction with the accompanying drawings, in which:

DETAILED DESCRIPTION OF THE DISCLOSURE

Figure 1:
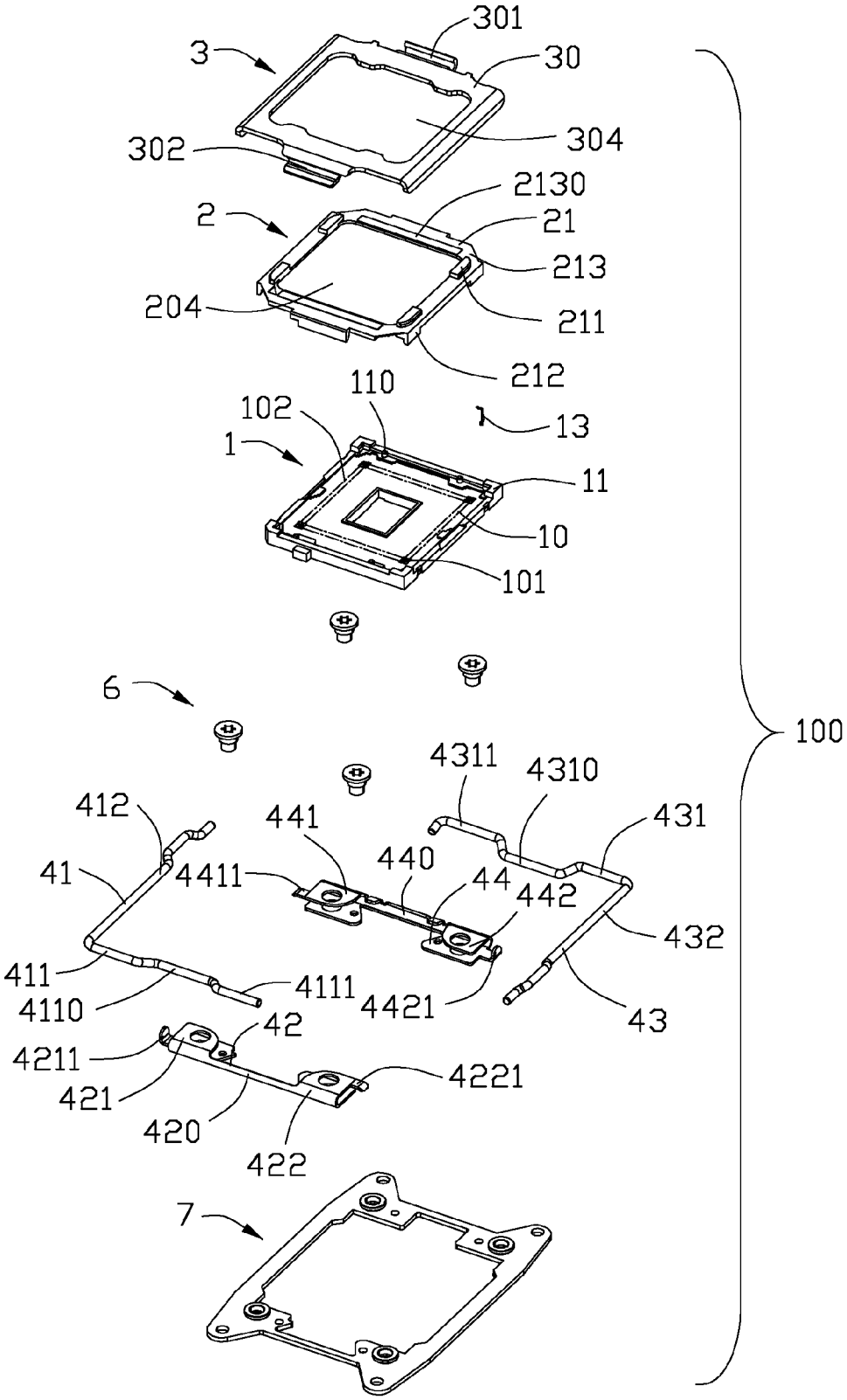
FIG. 1 is an exploded, perspective view of an electrical connector in accordance with a first embodiment of the present disclosure.

Reference will now be made to the drawings to describe the present disclosure in detail.

FIG. 1 to FIG. 5 shows a first embodiment of an electrical connector 100 in accordance with the present disclosure. The electrical connector 100 for electrically connecting an IC package 5 to a circuit board (not shown) comprises an insulating housing 1 with a plurality of contacts 13 received therein, a stiffener 7 surrounding the insulating housing 1, a first reinforcement member 42 and a second reinforcement member 44 assembled on the stiffener 7 and located at two sides of the insulating housing 1, a first lever 41 assembled on the first reinforcement member 42 and a second lever 43 assembled on the second reinforcement member 44, a load plate 3 covering the insulating housing 1, and a holder 2 assembled on the load plate 3 for carrying the IC package 5.

The insulating housing 1 is configured to rectangle shaped, and comprises a bottom wall 10 and four side walls 11 extending upwardly from the bottom wall 10. The bottom wall 10 and the side walls 11 together form a cavity 102 for receiving the IC package 5. Each of the side walls 11 comprises a plurality of first position posts 110 extending towards the cavity 102 for matching with cutouts 51 of the IC package 5.

The first reinforcement member 42 comprises a first portion 421, a second portion 422 and a first connecting portion 420 connecting the first portion 421 and the second portion 422. The first portion 421 comprises a first resistant portion 4211 extending upwardly from the first portion 421 while the second portion 422 comprises a first hook 4221 extending downwardly from the second portion 422. The second reinforcement member 44 is similar with the first reinforcement member 42, and comprises a third portion 442, a fourth portion 441 and a second connecting portion 440 connecting the third portion 442 and the fourth portion 441. The third portion 442 comprises a second resistant portion 4421 extending upwardly from the third portion 442 while the fourth portion 441 comprises a second hook 4411 extending downwardly from the fourth portion 441.

The first lever 41 comprises a first shaft portion 411 and a first driving portion 412 perpendicular to the first shaft portion 411. The first shaft portion 411 comprises a pair of first joint sections 4111 pivotally connecting to the first portion 421 and the second portion 422 of the first reinforcement member 42, and a first pressing section 4110 locating between the first joint sections 4111. The second lever 43 comprises a second shaft portion 431 and a second driving portion 432 perpendicular to the second shaft portion 431. The second shaft portion 431 comprises a pair of second joint sections 4311 pivotally connecting to the third portion 442 and the fourth portion 441 of the second reinforcement member 44, and a second pressing section 4310 locating between the second joint sections 4311.

The load plate 3 is metallic, and comprises a main body 30, a retention portion 301 and a tongue 302 extending from two opposite ends of the main body 30. The load plate 3 defines an opening 304.

The holder 2 comprises a frame 21 defining an opposite top surface 213 and bottom surface 214, a plurality of upward alignment members 211 extending upwardly from the top surface 213 of the frame 21, a plurality of downward alignment members 212 extending downwardly from the bottom surface 214 of the frame 21, and a plurality of position members 23 extending downwardly and adjacent to the downward alignment members 212. The frame 21 defines a second opening 204 corresponding with the opening 304 of the load plate 3.

Figure 2:
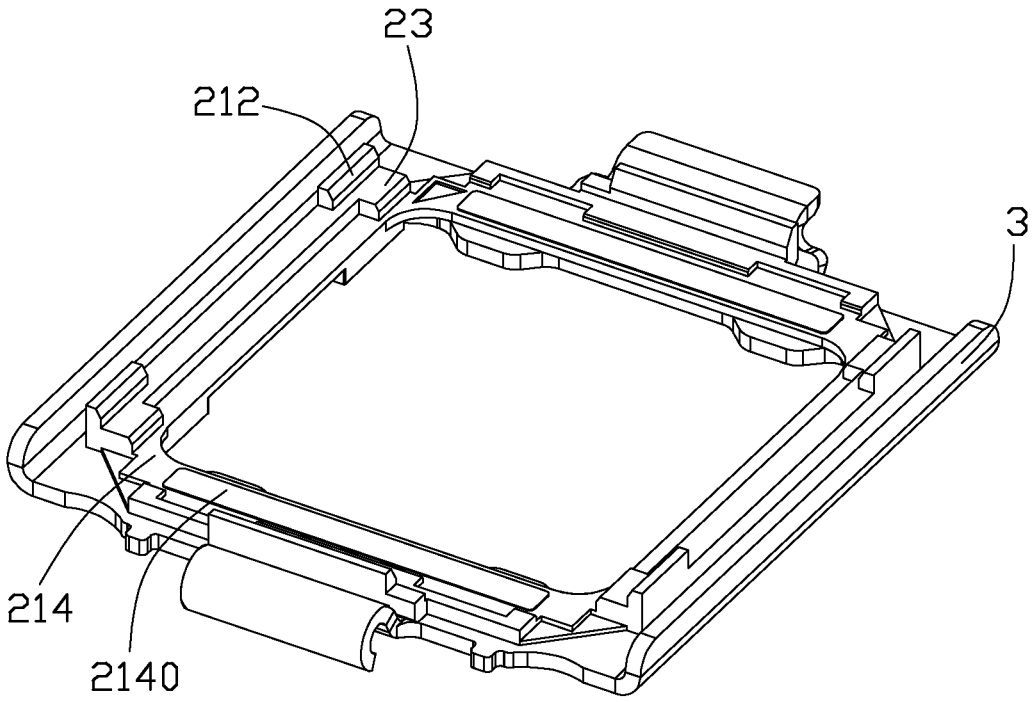
FIG. 2 is an assembled, perspective view of a holder and a load plate of the electrical connector shown in FIG. 1.
Figure 3:
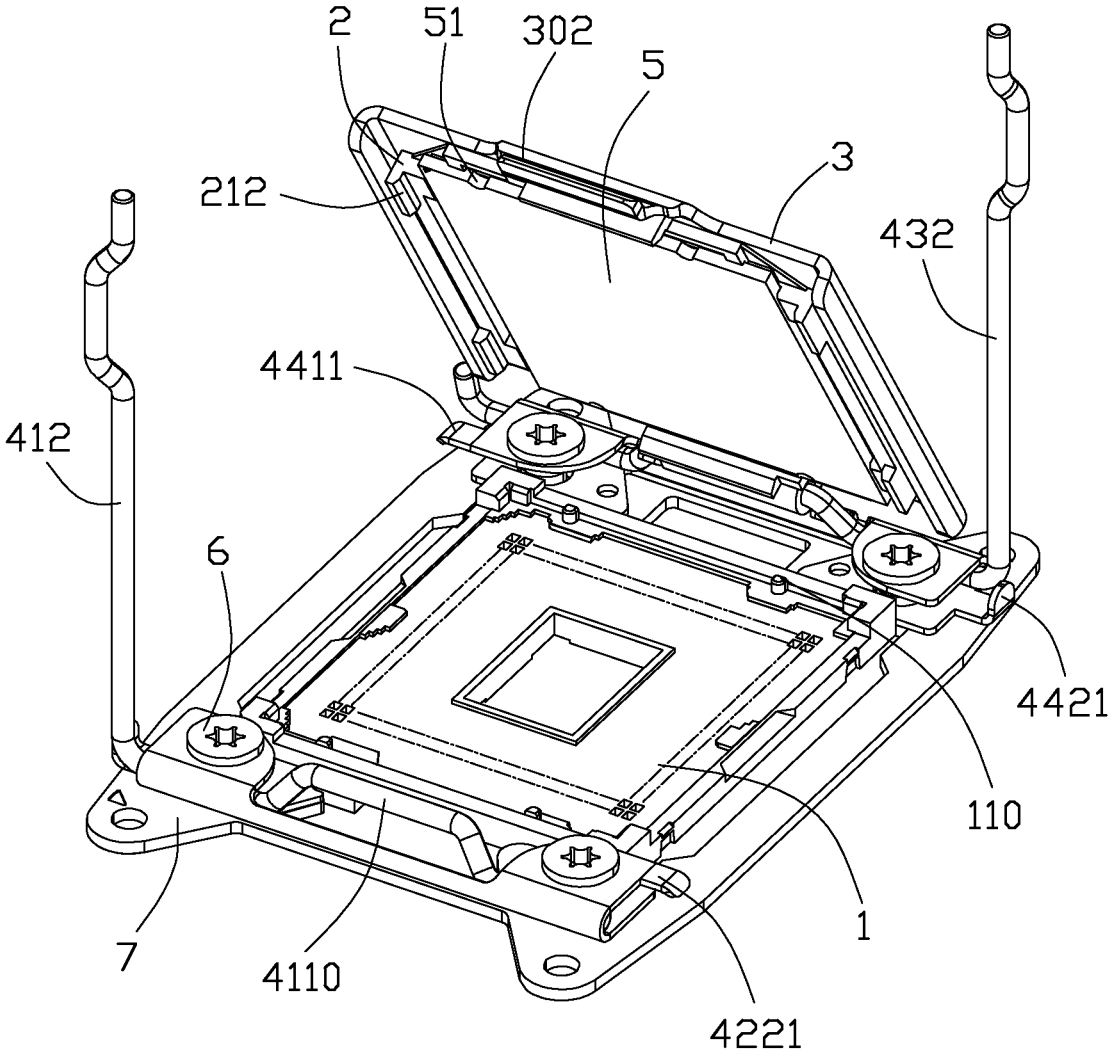
FIG. 3 is an assembled, perspective view of the electrical connector as shown in FIG. 1, wherein an IC package is assembled thereon, and the load plate and the lever are opened.
Figure 4:
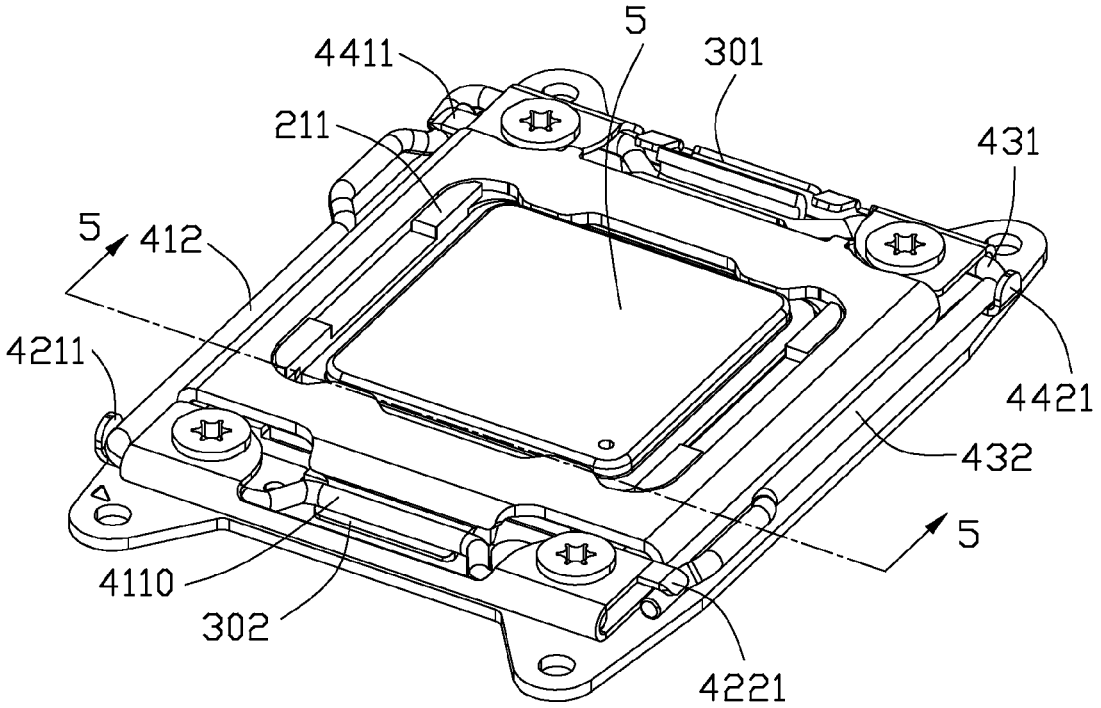
FIG. 4 is an assembled, perspective view of the electrical connector and the IC package shown in FIG. 3, wherein the load plate and the lever are closed.

In the first embodiment of the present disclosure, the IC package 5 is pasted on the holder 2, and the holder 2 is pasted on the load plate 3. The top surface 213 and the bottom surface 214 have glue 2130, 2140 thereon. Referring to FIG. 4, the upward alignment members 211 are situated in the opening 304 and lean against the load plate 3. Referring to FIG. 2 and FIG. 3, the position members 23 are situated on the sides of the IC package 5 to position the IC package 5 thereon.

Figure 5:
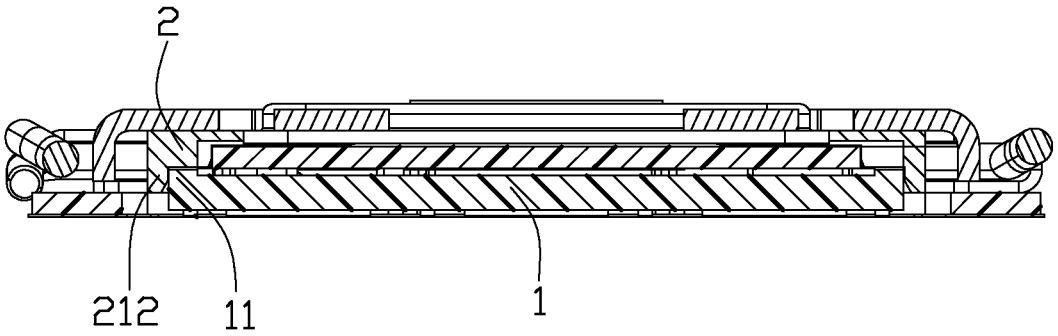
FIG. 5 is a cross sectional view of the electrical connector and the IC package along line 5-5 shown in FIG. 4.

Please referring to FIG. 3 to FIG. 5, when used, the first and second reinforcement member 42, 44 are fixed on the stiffener 7 by screws 6. The first lever 41 is assembled on the first reinforcement member 42 while the second lever 43 is assembled on the second reinforcement member 44. The retention portion 301 is pivotally connecting with the second pressing portion 4310 of the second lever 43. The IC package 5 is pasted on the holder 2, and the holder 2 is pasted on the load plate 3. In operation, firstly, the load plate 3 together with the holder 2 and the IC package 5 is driven to cover the insulating housing 1. Secondly, the first lever 41 is driven to make the first pressing section 4110 press on the tongue 302, and the first driving portion 412 engages with the second hook 4411. Finally, the second lever 43 is driven to make the second pressing section 4310 press on the retention portion 301, and the second driving portion 432 engages with the first hook 4221. The first and the second resistant portion 4211, 4421 prevent the first and the second lever 41, 43 from getting away from the first and the second reinforcement member 42, 44.

According to the above described embodiment of the present disclosure, rotating the load plate 3 to a closed position is capable of loading the IC package 5 into the insulating housing 1. The upward alignment members 211 ensure the holder 2 assembled on the load plate 3 in a correct position. When closed, the downward alignment members 212 are situated beyond and lean against the side walls 11 of the insulating housing 1 to ensure the holder 2 loading the IC package 5 onto the insulating housing 1 in a correct position.

Figure 6:
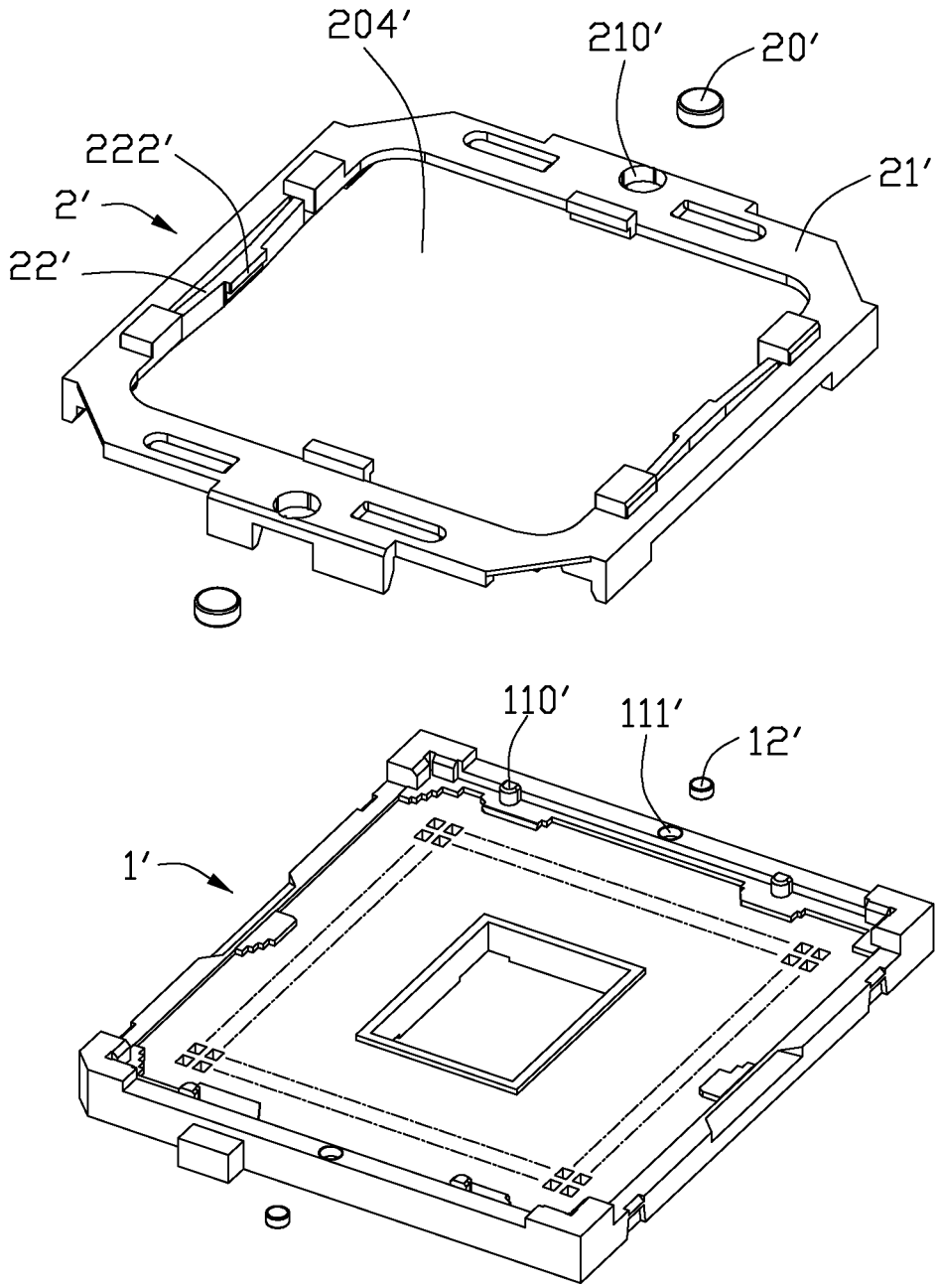
FIG. 6 is an exploded, perspective view of the holder and the insulating housing in accordance with a second embodiment of the present disclosure.
Figure 7:
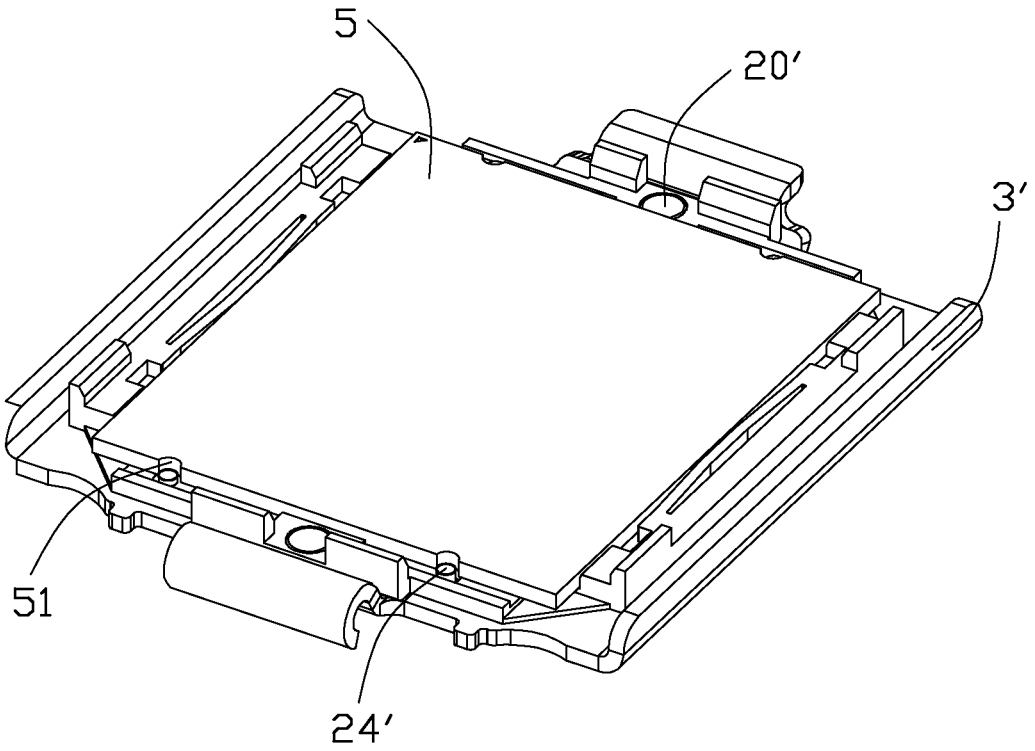
FIG. 7 is an assembled view of the holder shown in FIG. 6 with an IC package and a load plate.

FIG. 6 and FIG. 7 are a second embodiment of the present disclosure, the difference between the second embodiment and the first embodiment is the way of the IC package assembled on the holder and the holder assembled on the load plate. The frame 21' of the holder 2' comprises holes 210' having magnets 20' therein for assembling the holder 2' on the load plate 3' by magnetic force. The frame 21' comprises a pair of elastic arms 22' extending horizontally towards the second opening 204' for pushing sides of the IC package 5. The elastic arm 22' is arc-shaped and the middle of the elastic arm 22' defines a pushing portion 222' for retaining the IC package 5. The holder 2' comprises a plurality of second position posts 24' corresponding to the first position posts 110' capable of matching with the cutouts 51 of the IC package 5. The side walls 11' of the insulating housing 1' comprise holes 111' having magnets 12' received therein capable of attracting with the magnets 20' of the holder 2'.

Figure 8:
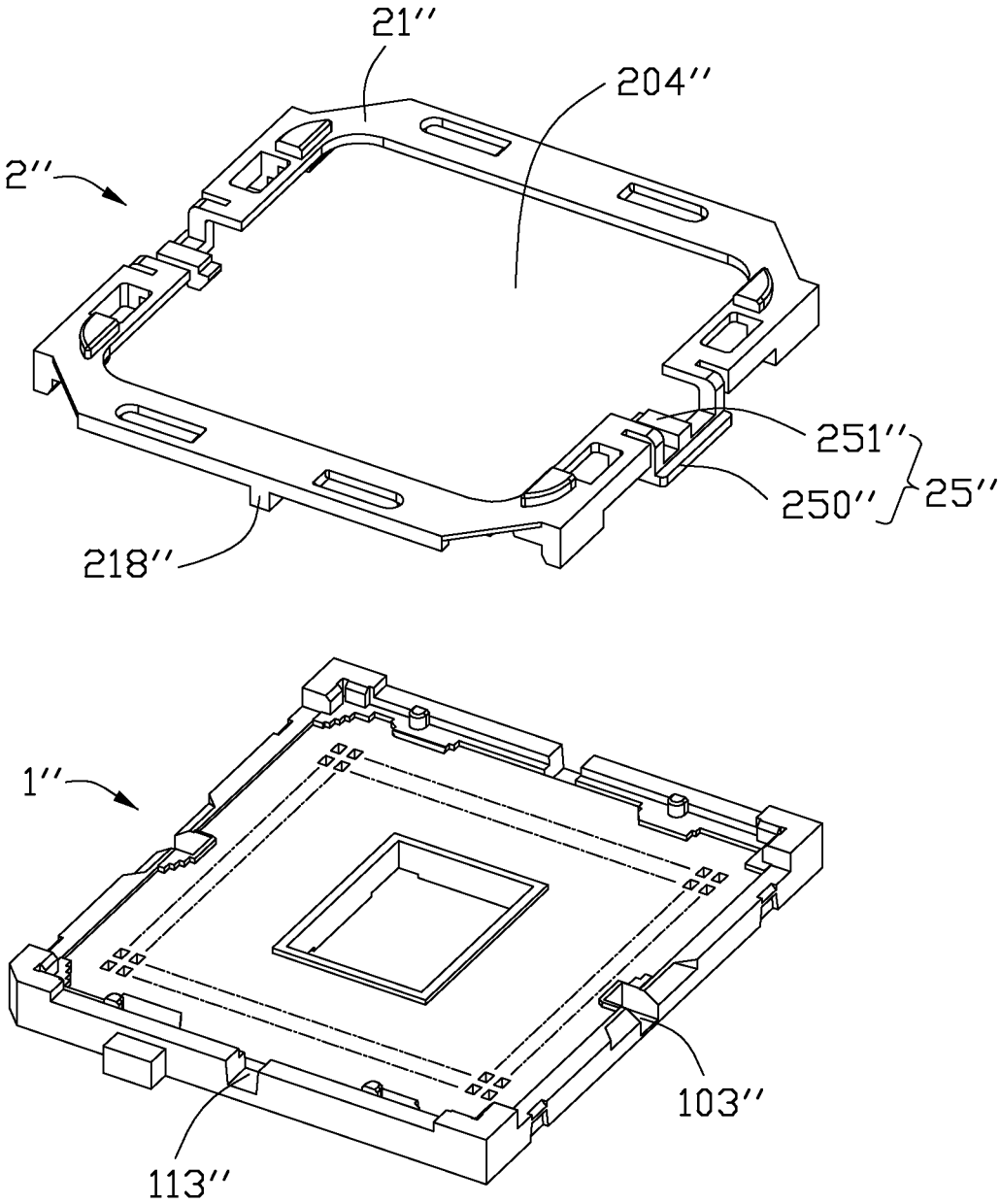
FIG. 8 is an exploded, perspective view of the holder and the insulating housing in accordance with a third embodiment of the present disclosure.
Figure 9:
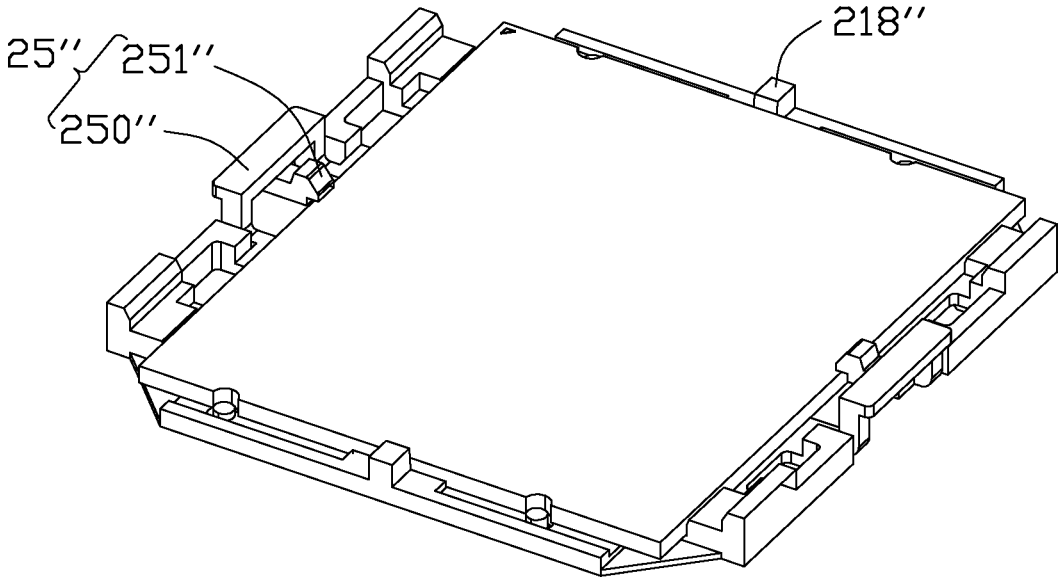
FIG. 9 is an assembled view of the holder shown in FIG. 8 with an IC package.

FIG. 8 and FIG. 9 are a third embodiment of the present disclosure, the difference between the third embodiment and the first embodiment is the way of the IC package assembled on the holder. The holder 2" comprises grippers 25". Each gripper 25" comprises an operation portion 250" extending downwardly from the frame 21" and a gripping portion 251" extending towards the second opening 204". The holder 2" also comprises a plurality of embosses 218" extending downwardly. The insulating housing 1" comprises recesses 103", 113" for receiving the grippers 25" and embosses 218". The holder 2" is pasted on the load plate, and the gripper 25" interlocks with the bottom surface of the IC package 5 to retain the IC package 5 on the holder 2".

Figure 10:
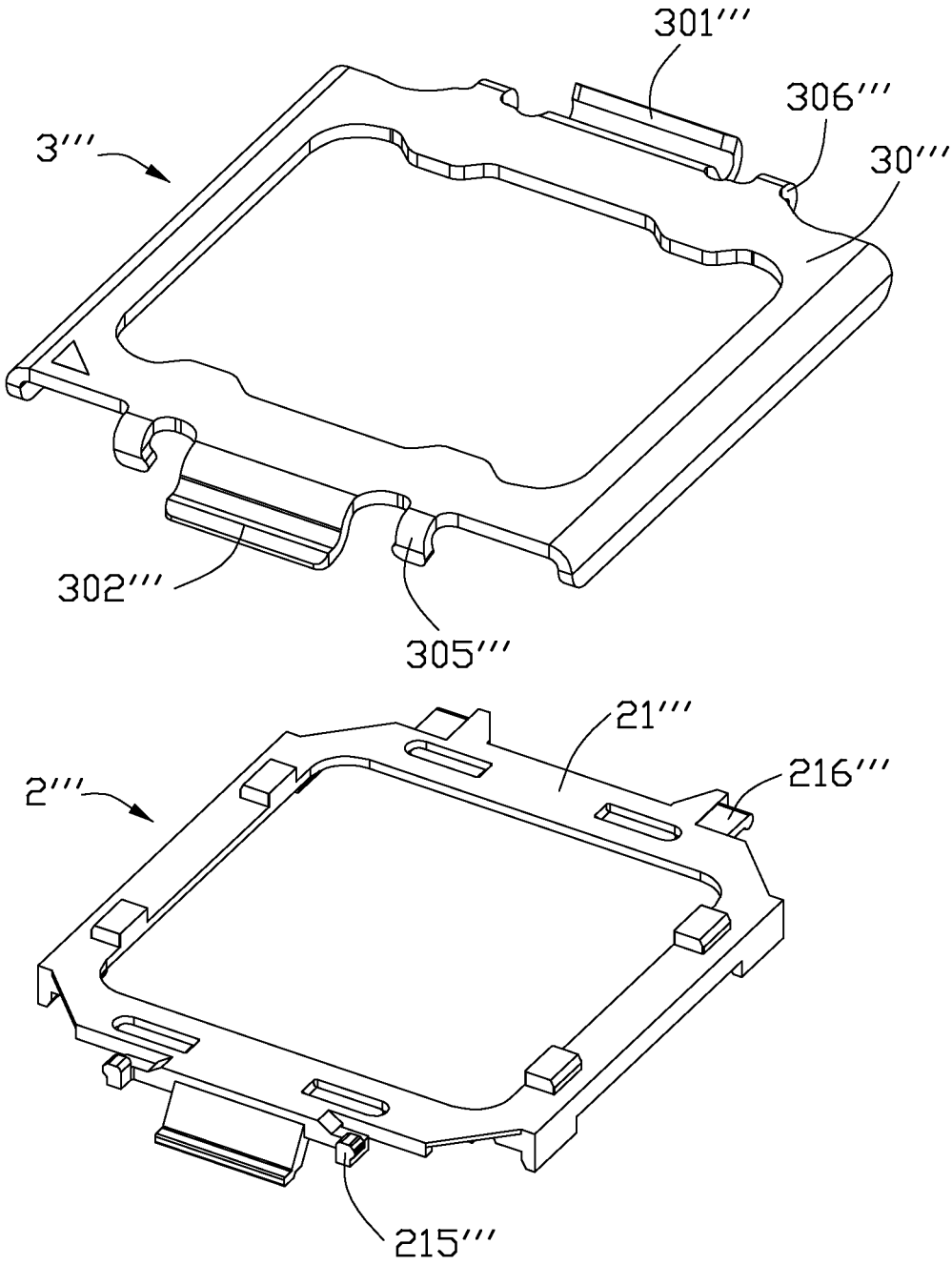
FIG. 10 is an exploded, perspective view of the load plate and the holder with a fourth embodiment of the present disclosure.
Figure 11:
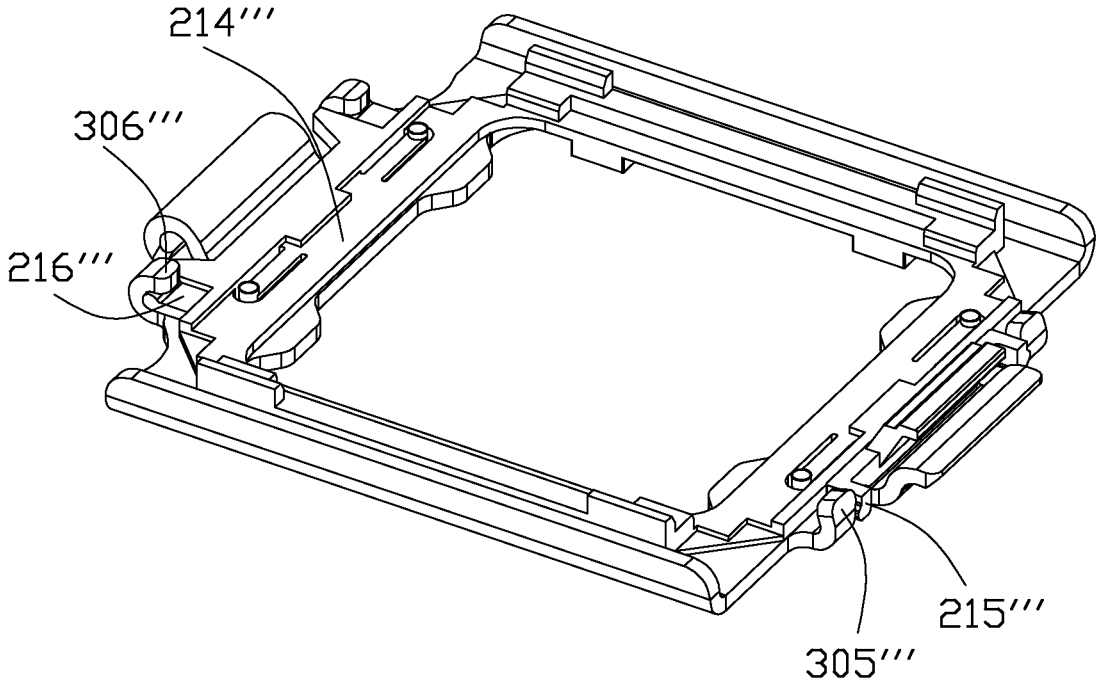
FIG. 11 is an assembled, perspective view of the load plate and the holder shown in FIG. 10.

FIG. 10 and FIG. 11 are a fourth embodiment of the present disclosure, the difference between the fourth embodiment and the first embodiment is the way of the holder 2''' assembled on the load plate 3'''. The holder 2''' comprises a pair of latches 215''' and a pair of axles 216''' extending outwardly from two opposite ends of the frame 21'''. The load plate 3''' comprises a pair of tabs 305''' for matching with the latches 215''', and a pair of hinged slots 306''' for matching with the axles 216'''. The IC package 5 is pasted on the holder 2''' while the axles 216''' are pivotally connecting the hinged slots 306''' and the latches 215''' engage to the tabs 305'''.

Figure 12:
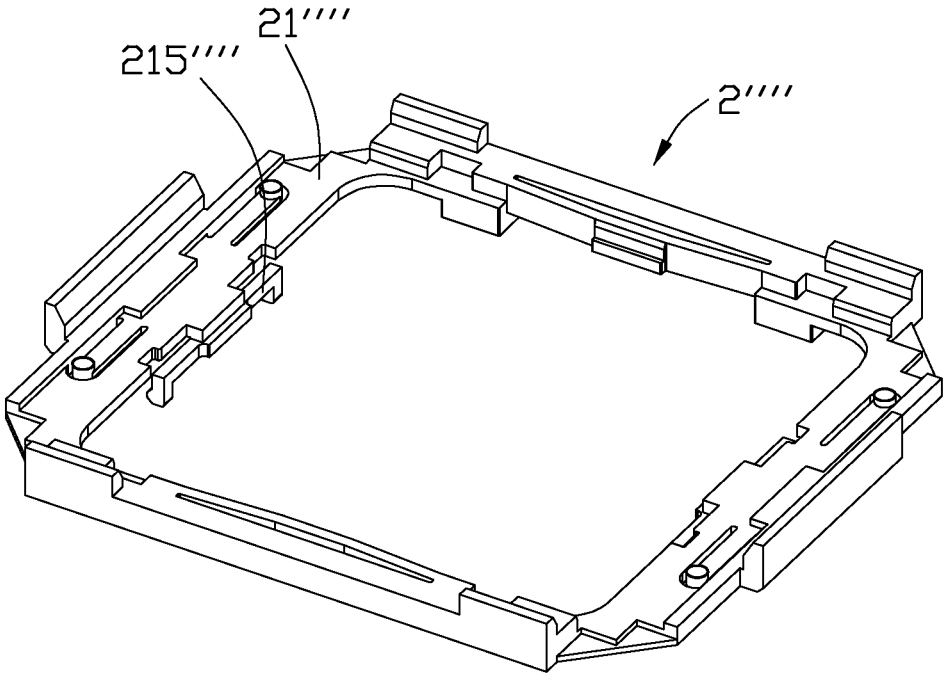
FIG. 12 is a perspective view of the holder in accordance with a fifth embodiment of the present disclosure.
Figure 13:
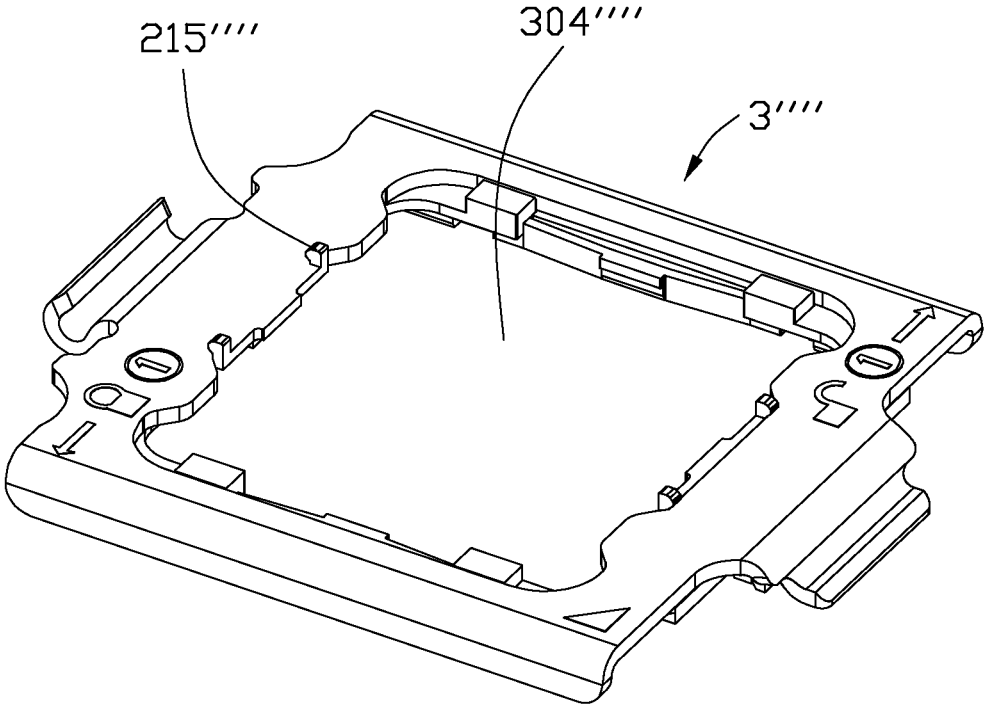
FIG. 13 is an assembled view of the holder shown in FIG. 12 with a load plate.

FIG. 12 and FIG. 13 are a fifth embodiment of the present disclosure, the difference between the fifth embodiment and the second embodiment is the way of the holder assembled on the load plate. The holder 2'''' comprises latches 215'''' extending upwardly from two opposite sides of the frame 21''''. The latches 215'''' are located on the opening 304'''' and engaged with the load plate 3''''.

While preferred embodiments in accordance with the present disclosure has been shown and described, equivalent modifications and changes known to persons skilled in the art according to the spirit of the present disclosure are considered within the scope of the present disclosure as defined in the appended claims.

What is claimed is:

1. An electrical connector for electrically connecting an IC package to a circuit board comprising:

an insulating housing having a plurality of contacts received therein;

a load plate for loading the IC package to the insulating housing, and capable of rotating between an open position and a closed position; and a holder capable of being assembled on the load plate for carrying the IC package thereon, and rotating the IC package into the insulating housing when the load plate is rotated to the close position.

2. The electrical connector as claimed in claim 1, wherein the assembly method of the IC package with the holder or the holder with the load plate is by pasting, magnetic force or mechanical retention.

3. The electrical connector as claimed in claim 1, wherein the load plate comprises an opening, and the holder comprises a plurality of upward alignment members extending upwardly and situated in the opening.

4. The electrical connector as claimed in claim 1, wherein the holder comprises a plurality of downward alignment members extending downwardly and situated beyond the insulating housing.

5. The electrical connector as claimed in claim 1, wherein the holder comprises a plurality of position members situated on sides of the IC package to position the IC package thereon.

6. The electrical connector as claimed in claim 2, wherein both assembly methods of the IC package with the holder and the holder with the load plate are by pasting.

7. The electrical connector as claimed in claim 2, wherein the holder comprises magnets for attracting the load plate, and elastic arms extending horizontally for pushing sides of the IC package to retain the IC package thereon.

8. The electrical connector as claimed in claim 7, wherein the housing comprises holes having magnets received therein corresponding to the magnets of the holder for attracting with each other.

9. The electrical connector as claimed in claim 2, wherein the holder is pasted on the load plate, and comprises grippers extending downwardly for gripping the bottom of the IC package to retain the IC package thereon.

10. The electrical connector as claimed in claim 9, wherein the gripper further comprises an operation portion extending downwardly for pressing by a finger and a gripping portion extending horizontally from the operation portion, when the operation portion pressed, the gripping portion is opened for the assembly or removal of the IC package.

11. The electrical connector as claimed in claim 2, wherein the IC package is pasted on the holder while the load plate comprises tabs and hinged slots extending outwardly at two opposite ends of the load plate, the holder comprises axles pivotally connecting with the hinged slots, and latches engaged with tabs so as to retain the holder on the load plate.

12. The electrical connector as claimed in claim 2, wherein the load plate comprises an opening, the holder comprises latches extending upwardly and located in the opening for engaging with the load plate, and elastic arms extending horizontally for pushing sides of the IC package to retain the IC package thereon.

13. An electrical connector for use with an electronic package, comprising:

an insulative housing defining a receiving cavity upwardly facing toward an exterior in a vertical direction for receiving the electronic package;

a plurality of contacts disposed in the housing with contacting sections upwardly extending into the receiving cavity;

a metallic load plate rotatably moveable relative to the housing about a pivotal axis located proximate one end of the housing in a lengthwise direction perpendicular to said vertical direction, and extending along a transverse direction perpendicular to both said vertical direction and said lengthwise direction; and a holder being discrete from the housing and the load plate; wherein said holder includes means for carrying the electronic package and means for attachment to the load plate for loading the electronic package unto the housing in an associative rotation manner with the load plate.

14. The electrical connector as claimed in claim 13, wherein said holder includes alignment means for aligning the holder with at least one of the load plate and the housing during operation.

15. The electrical connector as claimed in claim 13, wherein said means for carrying the electronic package or for attachment to the load plate includes one of deflectable arrangement, adherent arrangement, magnetic arrangement, and interferential arrangement.

16. The electrical connector as claimed in claim 13, wherein said holder is less stiff than the load plate for adjusting proper position of the electronic package relative to the housing.

17. The electrical connector as claimed in claim 13, wherein both said load plate and said holder are of a frame configuration with corresponding openings for allowing the electronic package to upwardly communicate with the exterior.

18. An electrical connector for use with an electronic package, comprising:

an insulative housing defining a receiving cavity upwardly facing toward an exterior for receiving said electronic package;

a plurality of contacts disposed in the housing with contacting sections upwardly extending into the receiving cavity for contacting the electronic package;

a metallic load plate associative assembled around one end of the housing in a rotational manner; and a holder assembled, along a face-to-face direction, to the load plate in a face-to-face manner; wherein said holder is configured for allowing the electronic package to be assembled thereto in said face-to-face direction.

19. The electrical connector as claimed in claim 18, wherein both said holder and said load plate are of a frame configuration with corresponding openings for allowing the electronic package to upwardly communicate with the exterior.

20. The electrical connector as claimed in claim 18, wherein said holder is plastic and materially softer than the load plate.

* * * * *